US007549609B2

(12) United States Patent
Ring

(10) Patent No.: US 7,549,609 B2
(45) Date of Patent: Jun. 23, 2009

(54) METHOD OF AND AN APPARATUS FOR POWERING AND CONTROLLING A MODEL RAILROAD END OF TRAIN DEVICE

(76) Inventor: Michael E. Ring, 13148 James Dr., Saint John, IN (US) 46373

( * ) Notice: Subject to any disclaimer, the term of this patent is extended or adjusted under 35 U.S.C. 154(b) by 0 days.

(21) Appl. No.: 10/821,735

(22) Filed: Apr. 8, 2004

(65) Prior Publication Data

US 2004/0238694 A1 Dec. 2, 2004

(51) Int. Cl.
*A63H 19/00* (2006.01)
*B61D 1/00* (2006.01)

(52) U.S. Cl. ..... 246/1 C; 246/473 R; 246/473 A; 246/167 R; 105/157.2

(58) Field of Classification Search ..... 246/122 A, 246/267 R, 187 A, 1 C, 473 R, 473 A, 167 R; 315/51; 446/438; 701/19; 105/26.05, 157.2; 104/296

See application file for complete search history.

(56) References Cited

U.S. PATENT DOCUMENTS 3,675,586 A * 7/1972 Haddad ..... 104/300
4,512,483 A * 4/1985 Crossley et al. ..... 213/75 TC
5,174,216 A * 12/1992 Miller et al. ..... 104/296
5,873,638 A * 2/1999 Bezos ..... 303/47
6,014,934 A * 1/2000 Pierson ..... 105/26.05
6,159,069 A * 12/2000 Grapp ..... 446/438
6,513,763 B1 * 2/2003 Ireland ..... 246/122 R
6,621,222 B1 * 9/2003 Hong ..... 315/51
6,765,356 B1 * 7/2004 Denen et al. ..... 318/6
2003/0015626 A1 * 1/2003 Wolf et al. ..... 246/187 A
2003/0155470 A1 * 8/2003 Young et al. ..... 246/122 A

OTHER PUBLICATIONS

Digital Command Control—the comprehensive guide to DCC, Stan Ames et al, 1998, pp. 29-30.*
The Digitrax—Big Book of DCC, 1999, pp. 95-97.*
The Digitrax—Big Book of DCC, 1999, pp. 25-38.*
List of Scale Model Sizes, Wikipedia, 3 pages, searched Mar. 5, 2007.*

* cited by examiner

*Primary Examiner*—Mark T Le
(74) *Attorney, Agent, or Firm*—James Ray & Assoc.

(57) ABSTRACT

An apparatus for converting electrical energy to a signal suitable for driving a light element in an End of Train device in a model train track arrangement. The apparatus includes an EOT device engageable with a model railway vehicle that can be easily installed and removed for relocation between model railway vehicles. A control system for such EOT device. At least a portion of an electronic circuit is disposed at least one of on a truck of such model railway vehicle and a body portion of the EOT device for power conversion and light signal timing and at least one light element is disposed at least one of in and on such EOT device and connected to receive a signal from the electronic circuit.

13 Claims, 17 Drawing Sheets

METHOD OF AND AN APPARATUS FOR POWERING AND CONTROLLING A MODEL RAILROAD END OF TRAIN DEVICE

FIELD OF INVENTION

The present invention relates, in general, to model railroading and, more particularly, this invention relates to a method of and an apparatus for enabling the conversion of power for a more accurate timing and flashing of the light disposed in an End Of Train (EOT) device in a convenient, easy to use configuration.

BACKGROUND OF THE INVENTION

The model train industry, as is generally well recognized in the art prior, has always sought additional ways to make model trains operate more realistically, i.e., like real trains. In modern real trains, for example, the EOT device has replaced the caboose and would, therefore, be a highly desirable addition to model train enthusiasts. This EOT device has also been identified, by those familiar with real world railroading, as a Flashing Rear End Device or FRED. It should be noted that "EOT device" and "FRED" are being used synonymously in the following specification and claims.

Furthermore, as is equally well recognized in model train railroading, there are two different types of power which can be applied to the rails for most model railroad layouts. These are analog, the older type but which is still produced, and the newer type, digital. The National Model Railroad Association (NMRA) has created a standard by which most of the digitally powered model railroad layouts are designed around called Digital Command Control (DCC). This NMRA DCC standard is generally accepted by the model railroad industry and many of the vendors today manufacture model railroad devices which are compatible with the NMRA DCC standard.

Prior to the conception and development of the present invention, the only way to implement a realistic flashing EOT device, on a typical model railroad car, involved relatively large circuit components. These circuit components were typically hidden inside the model railway car bodies and powered from batteries which were also typically stored inside the car bodies.

This makes it almost impossible to put some model railway car types at the rear end of the model train simply due to their not having sufficient space, or geometry, to hide the required circuitry components within their car structure. Empty flat cars and well cars, in particular, would not be used because of such insufficient space to attach the electronics and/or batteries necessary to power the EOT device. Many model tank cars and numerous other types of cars also present an inconvenience when trying to access the inside for mounting these electronic parts.

With battery powered electronics, also comes the problems of running batteries dead, having to replace batteries, and in some designs, integrating non-contact magnetic switches into these electronic circuits to help with battery power conservation. By using the non-contact magnetic switches, the electronic circuit powered by these batteries could be turned on and off by simply passing a magnet along the outside of the car body. This, therefore, has helped to conserve the battery power while the EOT device was not being used and substantially eliminated the need to remove the car body for access to the electronic circuit inside to simply turn the EOT device on or off.

SUMMARY OF THE INVENTION

The present invention provides an apparatus for use in converting electrical energy to a signal which is suitable for driving a light element in an End of Train device in a model train track arrangement. The apparatus includes an EOT device engageable with a model railway vehicle that can be easily installed and removed for relocation between model railway vehicles. A control system for the EOT device. There is at least a portion of an electronic circuit disposed at least one of on a truck of such model railway vehicle and a body portion of such EOT device for power conversion and light signal timing. An at least one light element is disposed at least one of in and on the EOT device and connected to receive a signal from such electronic circuit.

OBJECTS OF THE INVENTION

It is, therefore, one of the primary objects of the present invention to provide a method of and an apparatus for converting both analog and digital track power to a signal suitable for realistically flashing the light of an EOT device for a railway vehicle of a model train arrangement.

Another object of the present invention is to provide a method of and an apparatus for reducing the physical size of the required electrical circuit, using SMT (Surface Mount Technology), to fit beneath an HO ($1/87^{th}$) scale model railroad truck assembly (approximately 0.8 inches by 0.3 inches by 0.06 inches) for ease of installation and moving between model rail cars as desired.

Still another object of the present invention is to provide an apparatus for collecting the track power through electrically conductive wheel and axle sets.

Yet another object of the present invention is to provide a method of and an apparatus for accurately setting the flash rate's pulse width and period of the EOT device's light.

A further object of the present invention is to provide an apparatus capable of moving the circuit board and EOT device attached to a coupler from car to car by means of at least one of a snap fit, screw, press-fit, or other coupler fastening method and a single truck fastener.

Yet another object of the present invention is to provide an apparatus including a means to continuously flash the EOT device's light on a digital model railroad system, even when the model train is stopped.

An additional object of the present invention is to provide an apparatus for collecting the track power through electrically conductive wheel and axle sets which is relatively inexpensive to produce.

In addition to the various objects and advantages of the present invention which have been described in some detail above, it should be noted that various other objects and advantages of the instant invention will become more readily apparent to those persons who are skilled in the relevant art from the following more detailed description of such invention, particularly, when such description is taken in conjunction with the attached drawing figures and with the appended claims.

Figure 1:
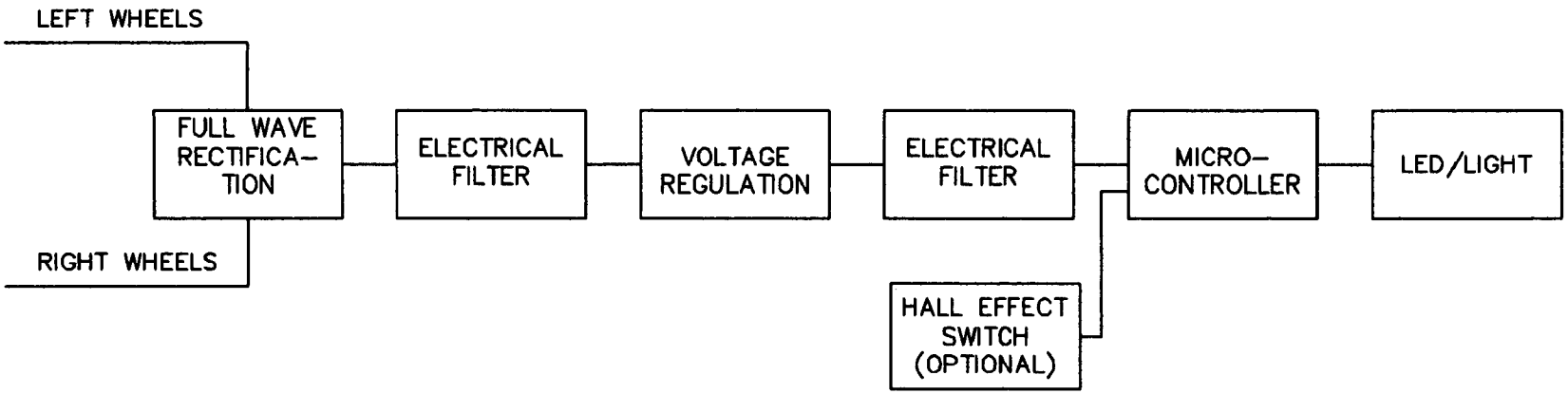
FIG. 1 is a schematic block diagram of the electrical circuit for use with an EOT device on a model train railway vehicle according to a presently preferred embodiment of the invention.

BRIEF DESCRIPTION OF A PRESENTLY PREFERRED AND VARIOUS ALTERNATIVE EMBODIMENTS OF THE INVENTION

Prior to proceeding to more detailed description of the present invention it should be noted that identical components which have identical functions have been identified with identical reference numerals throughout the several views illustrated in the drawings for the sake of clarity and understanding of the invention.

Figure 3:
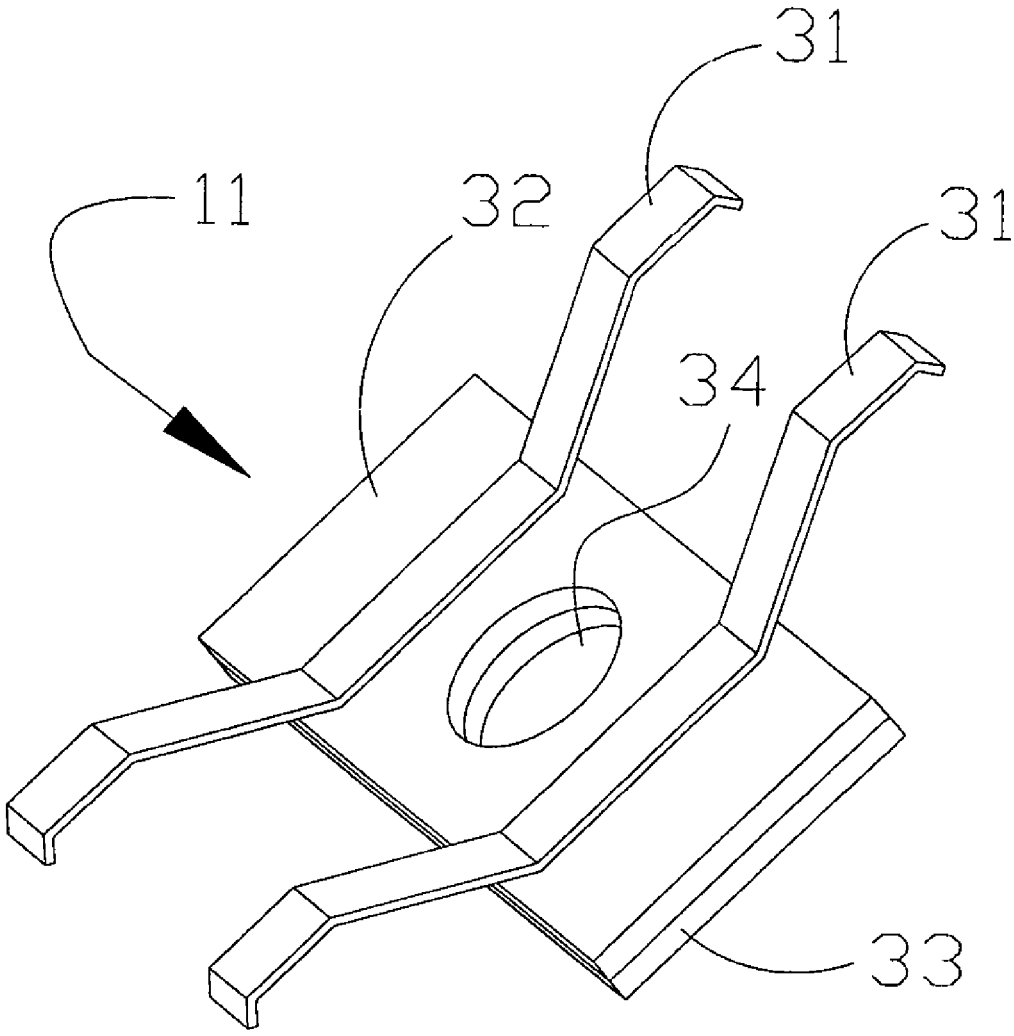
FIG. 3 is a top perspective view of the electronic circuit board used for converting the track power in a model train arrangement to a usable signal for the EOT device's light according to one presently preferred embodiment of the invention.

Reference is now made, more particularly, to FIGS. 1-11 of the drawings. Illustrated therein, for example, is a model railroad railway vehicle truck assembly, generally designated 10, for use in conducting electric current from the model railroad track to the circuit board assembly, generally designated 11 (FIG. 3).

Figure 8:
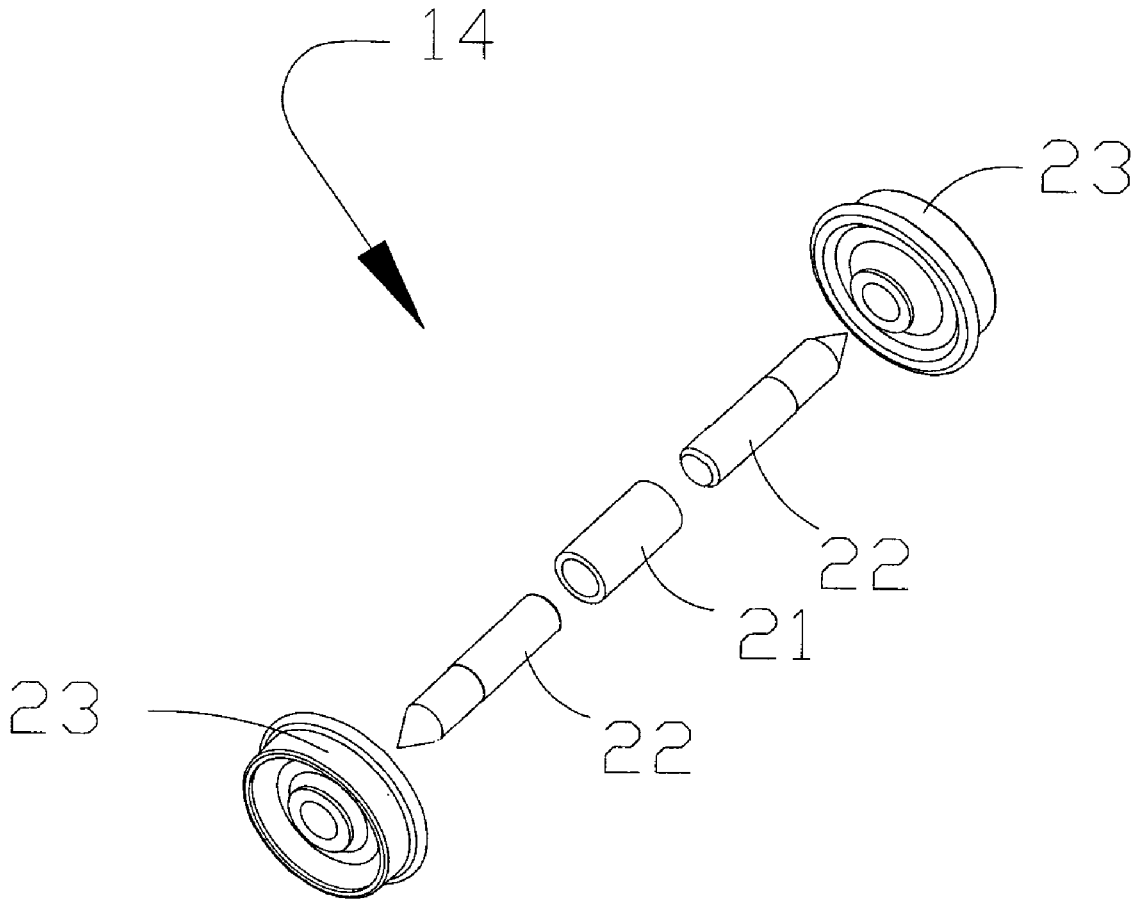
FIG. 8 is an exploded illustration of an electrically conductive wheel and axle set using a central insulator for electrical isolation from rail to rail according to an embodiment of the present invention.
Figure 9:
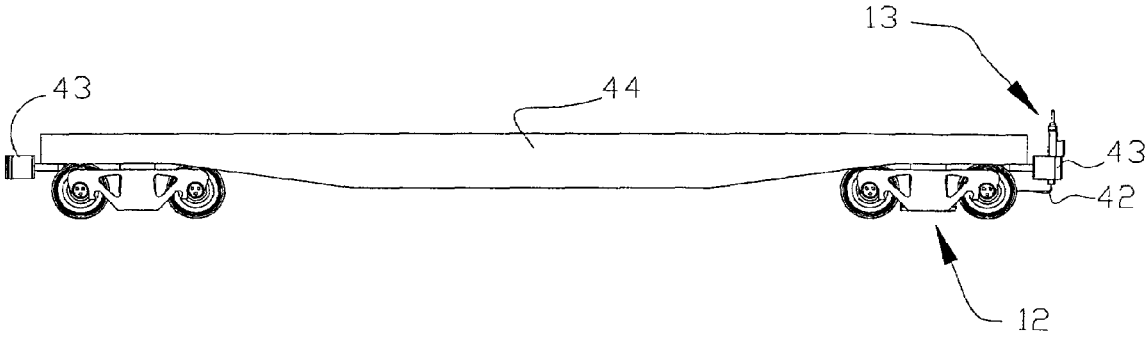
FIG. 9 is a side view illustration of the electrical circuit board and EOT device applied to a model rail car according to an embodiment of the present invention.
Figure 10:
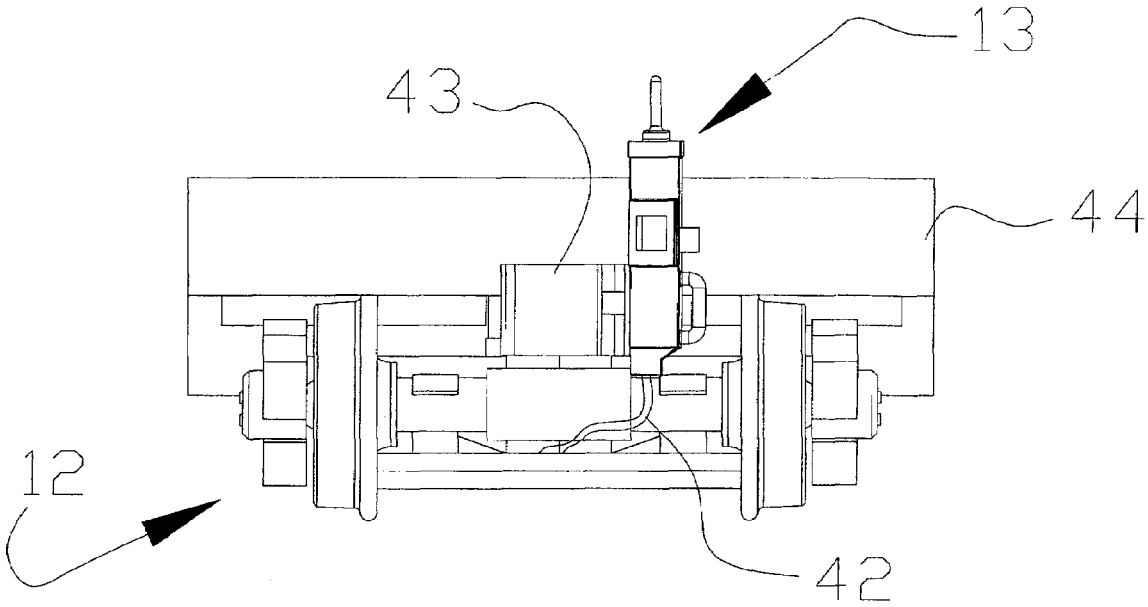
FIG. 10 is an end view illustration of the electrical circuit board and EOT device applied to a model rail car according to an embodiment of the present invention.
Figure 11:
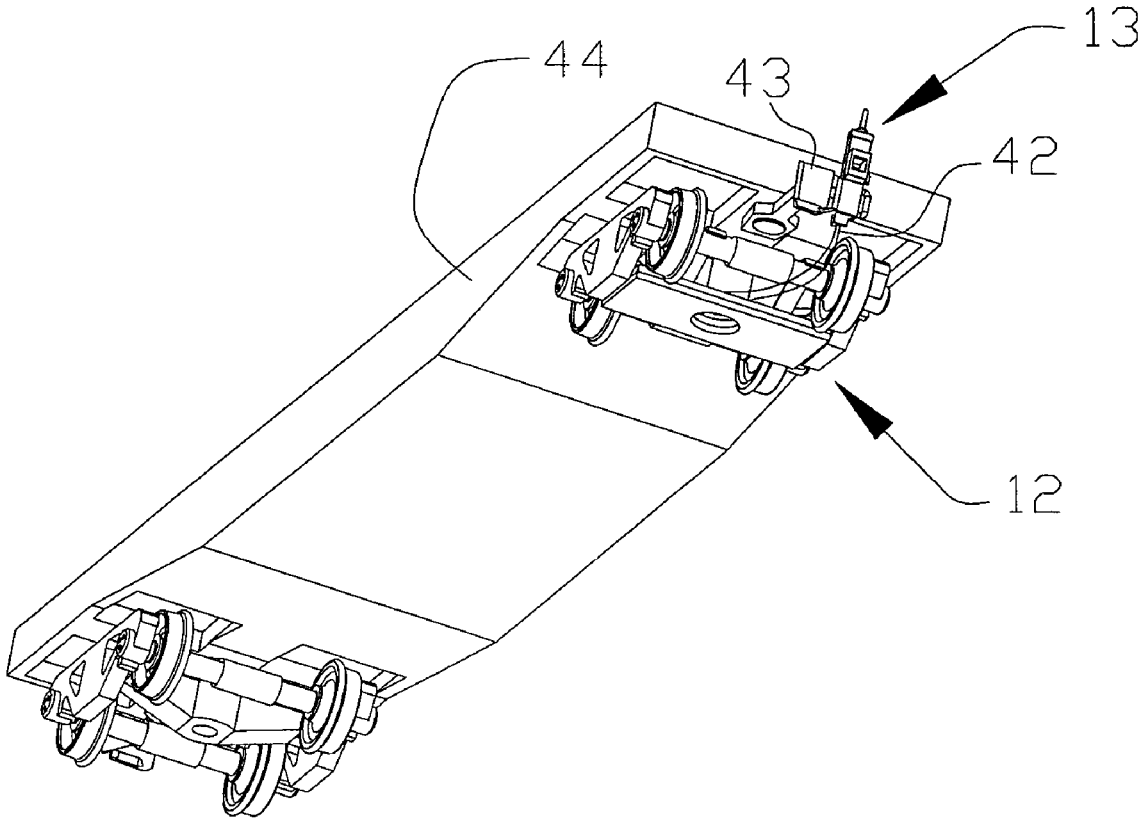
FIG. 11 is an isometric view illustration of the electrical circuit board and EOT device applied to a model rail car according to an embodiment of the present invention.

The truck assembly 10 contains a pair axle assemblies 14, best seen in FIG. 8. Each axle assembly 14 is constructed of a pair of electrically conductive wheels 23, a pair of electrically conductive axle shafts 22, and an electrically insulating axle coupling 21. The exposed portion of the axle shafts 22, inboard of the wheels 23 become the electrical contacts for the circuit board assembly 11, as well as the vertical, mechanical support points for the circuit board assembly 11.

A particular advantage to this design is that it provides for four contact points (two per rail) between the rail and the circuit board assembly 11. This allows for more efficient conduction of electrical current and reduces the chance for dirt or other contaminates to cause an intermittent electrical connection. Truck assembly 10 further includes a bolster 24 mounted between side frames 25.

A block diagram demonstrating the electrical functions of the components on the circuit board assembly 11 are shown in FIG. 1. This figure demonstrates the preferred method of conditioning the power coming from the model railroad track and ultimately flashing the EOT device's LED 41, disposed on housing 40, at the predetermined pulse width and period. This circuit board assembly makes use of a Surface Mount Technology (SMT) microcontroller that is software programmable for setting the pulse width and period to accurately and realistically flash the EOT device's LED 41 through wires 42 connected thereto. The presently preferred circuit also contains track power conditioning components including rectification diodes, analog filtering, and voltage regulation. The rectification diodes of the presently preferred invention are arranged for full wave rectification that allows more efficient conversion of alternating track signals, when present. Voltage regulation is also used to permit constant EOT device light 41 intensity, independent of voltage drops, spikes, or other track power irregularities. All components used in the presently preferred invention are SMT devices.

Utilization of (SMT) components is one of the key reasons the circuit board assembly 11 can be drastically reduced in size to the point that it can be assembled to the underside of an HO ($1/87^{th}$) scale model railroad truck assembly 10. This mounting position for the circuit board assembly 11 is an ideal location due to the close proximity to both the power on the track and the EOT device 13 found typically at the rear of the train consist. This helps eliminate the hassles of drilling holes in car bodies and trying to hide the typically larger circuit components of other customized designs.

Because of the reduced size of this design, the total truck mounted circuit board assembly 11 can be easily moved from car to car by typically removing a coupler 43 with the EOT device 13 attached to it, and one fastener holding the truck mounted circuit board assembly 11 to the car body 44. It can also be installed on car types that would typically be extremely difficult to hide larger components on, such as flat cars and well cars.

Figure 3A:
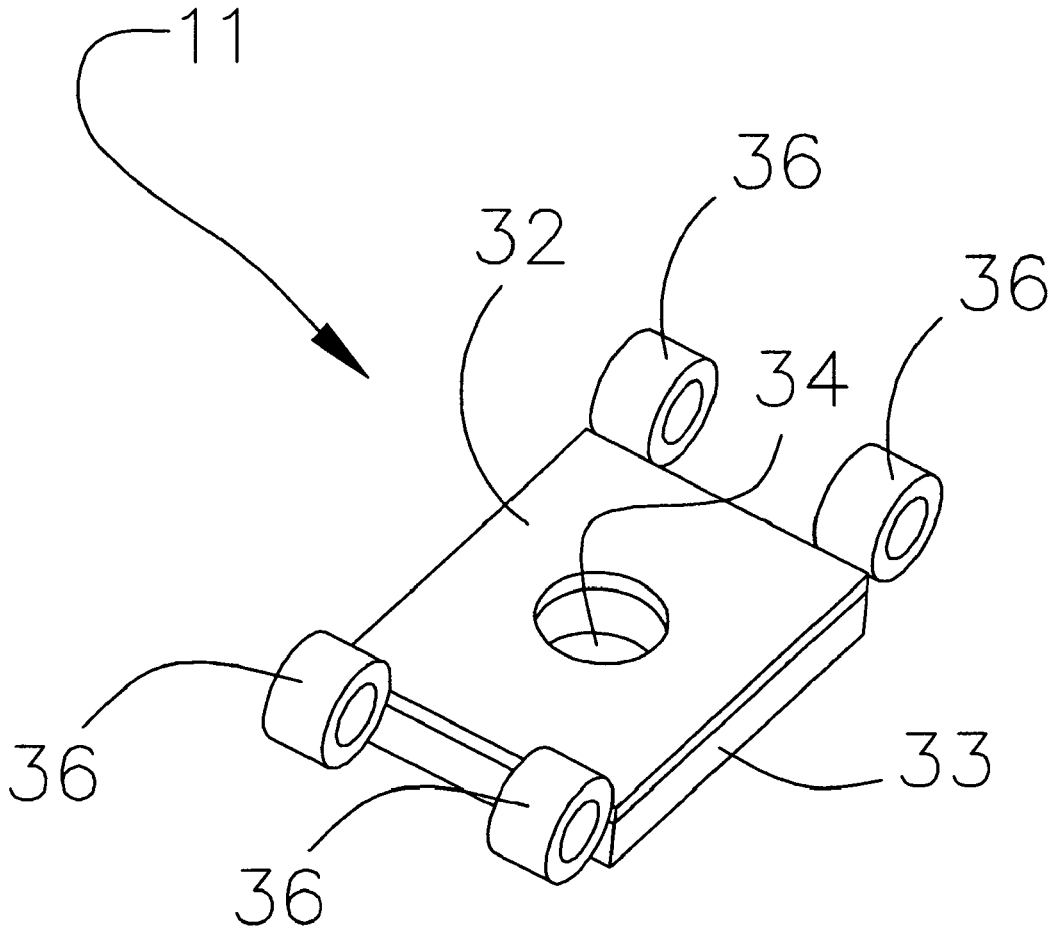
FIG. 3A is a top perspective view of a presently preferred alternative embodiment of the invention which is substantially the same as FIG. 3 except that it shows electrically conductive bushings which can be used instead of wiper contacts.
Figure 4:
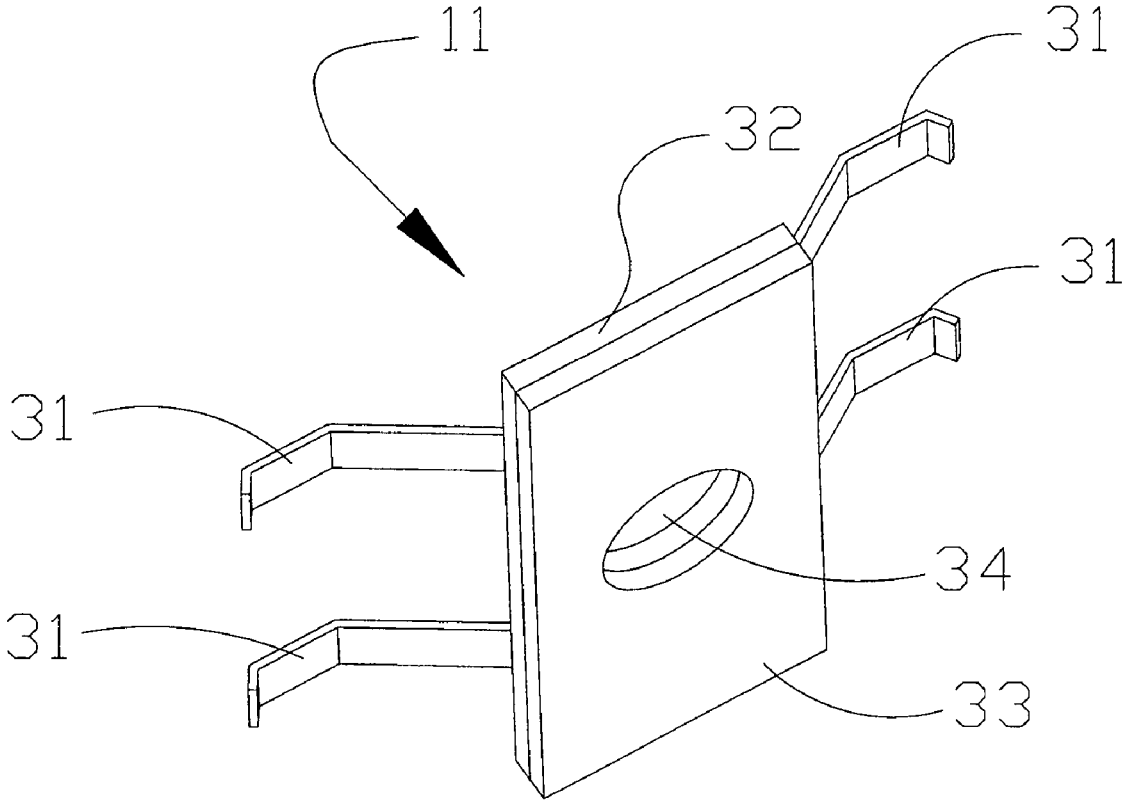
FIG. 4 is a bottom perspective view of the electronic circuit board illustrated in FIG. 3 used for converting the track power to a usable signal for the EOT device's lighting element.
Figure 4A:
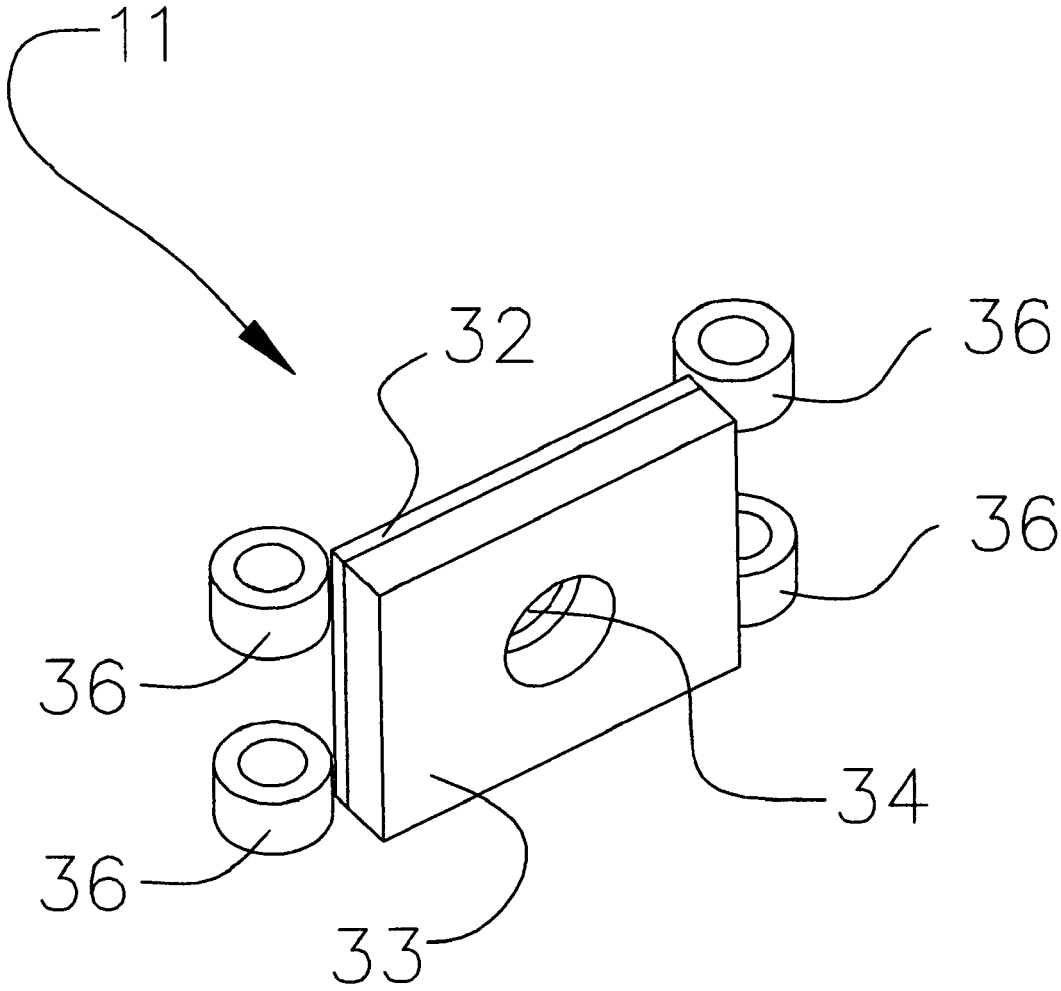
FIG. 4A is a bottom perspective view of the electronic circuit board illustrated in FIG. 4 except that it shows electrically conductive bushings usable instead of wiper contacts.
Figure 5:
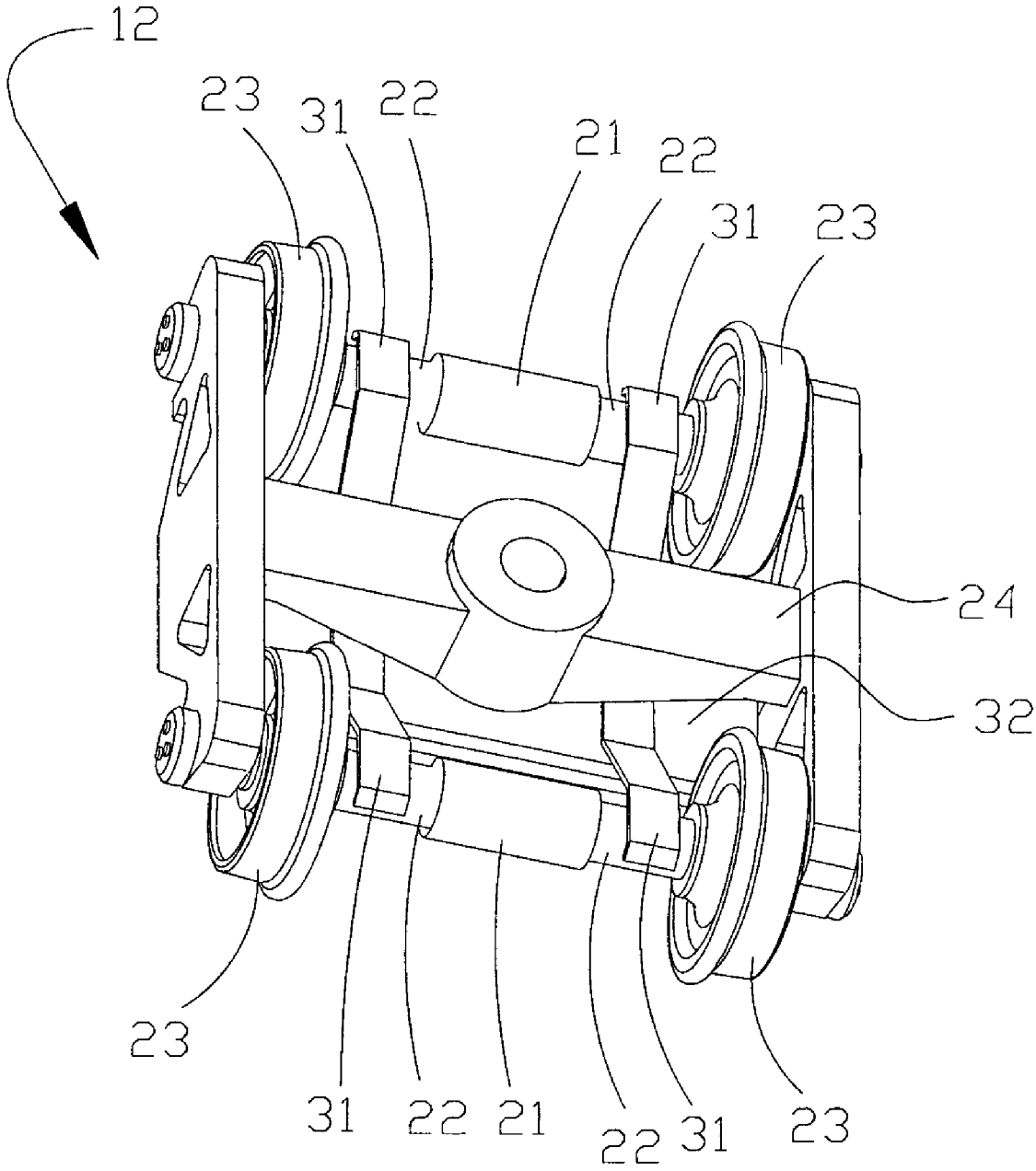
FIG. 5 is a top perspective view of the electronic circuit board assembled to the model rail car truck according to a presently preferred embodiment of the invention.
Figure 5A:
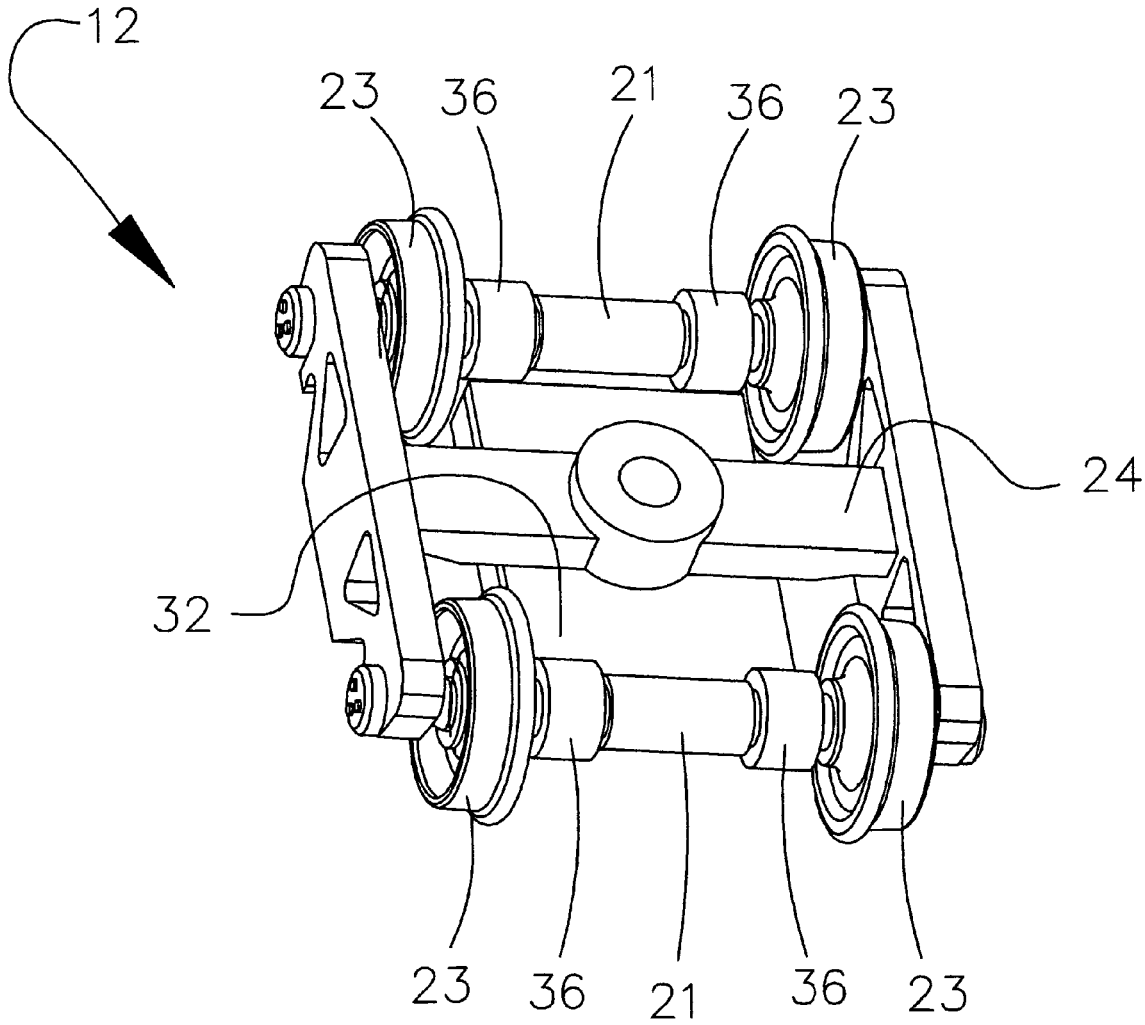
FIG. 5A is a top perspective view of the electronic circuit board assembled to the model rail car truck illustrated in FIG. 5 except that it shows electrically conductive bushings instead of wiper contacts.
Figure 6:
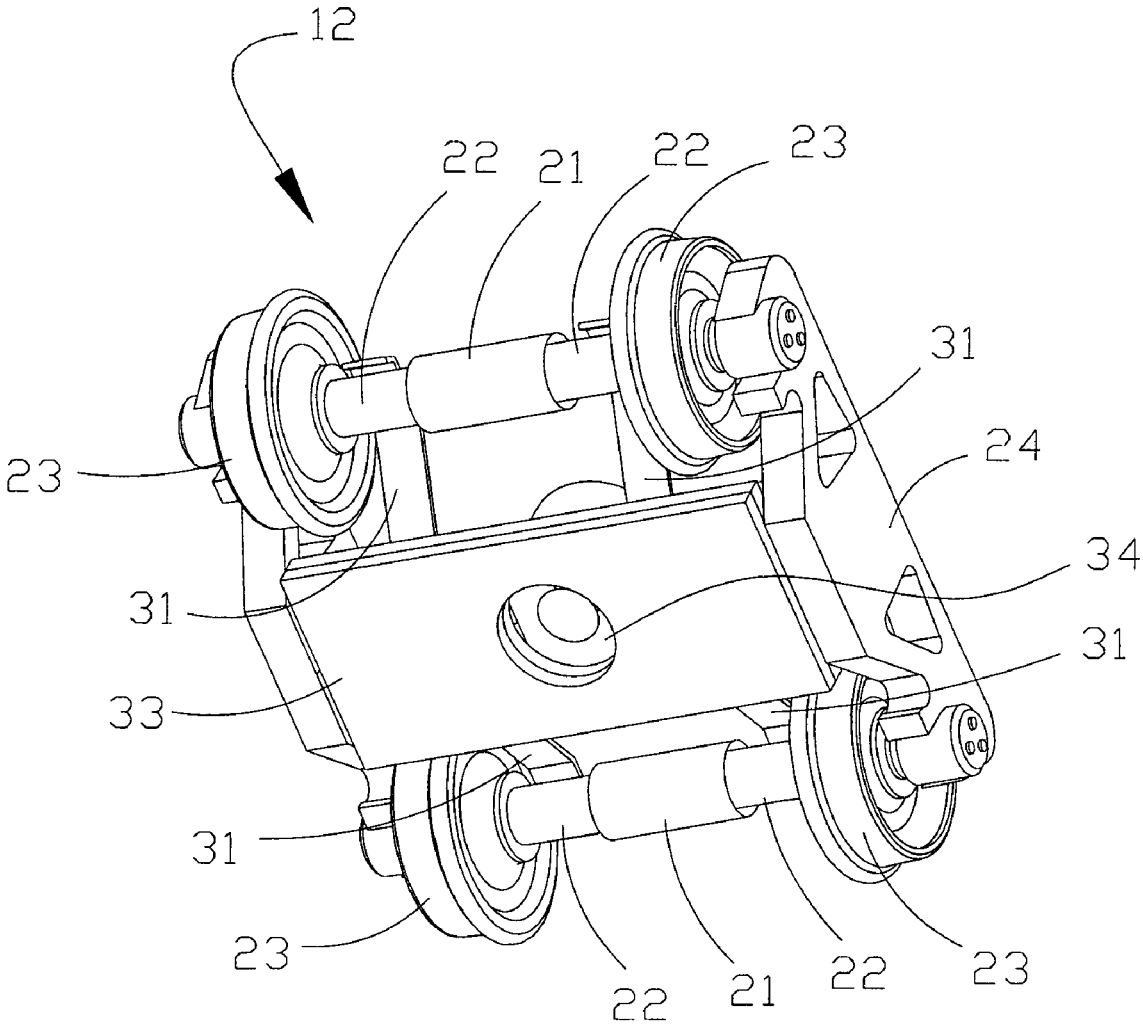
FIG. 6 is a bottom view illustration of the electronic circuit board assembled to the model rail car truck according to an embodiment of the present invention.
Figure 6A:
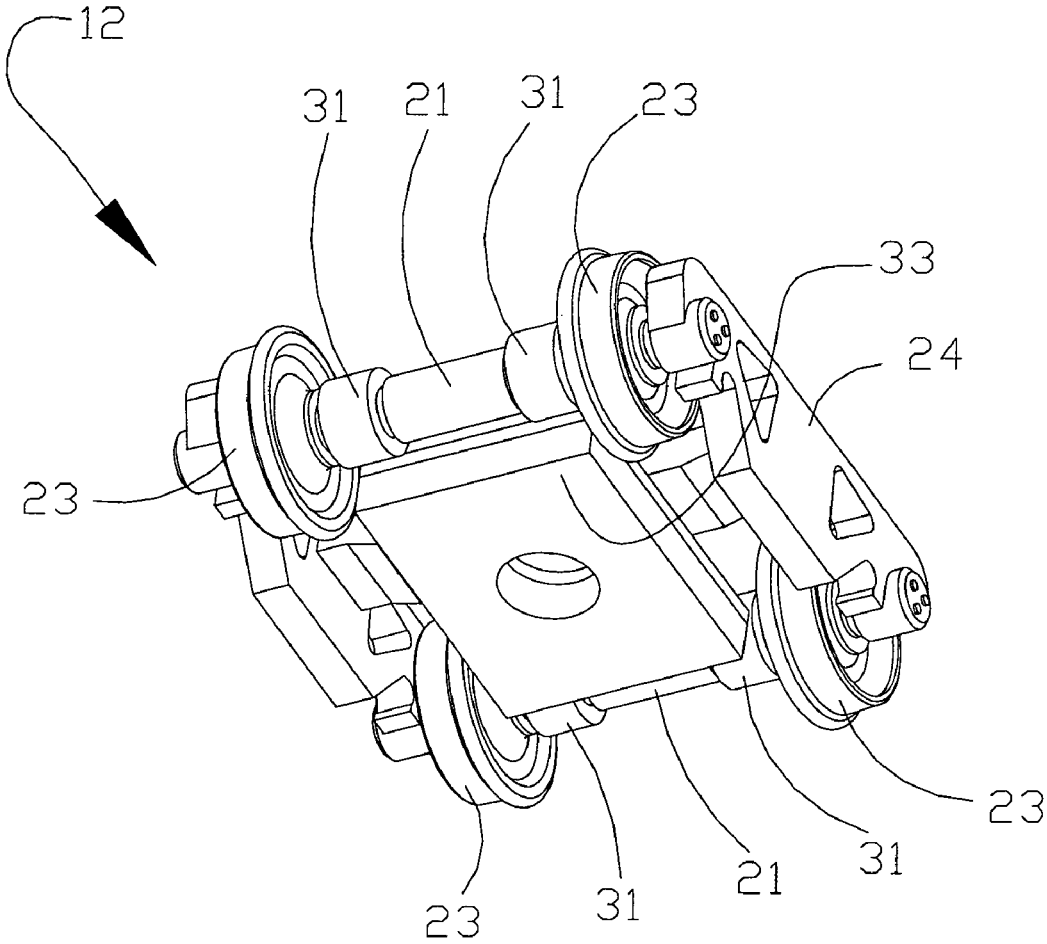
FIG. 6A is the same as FIG. 6 except that it shows electrically conductive bushings instead of wiper contacts.
Figure 7:
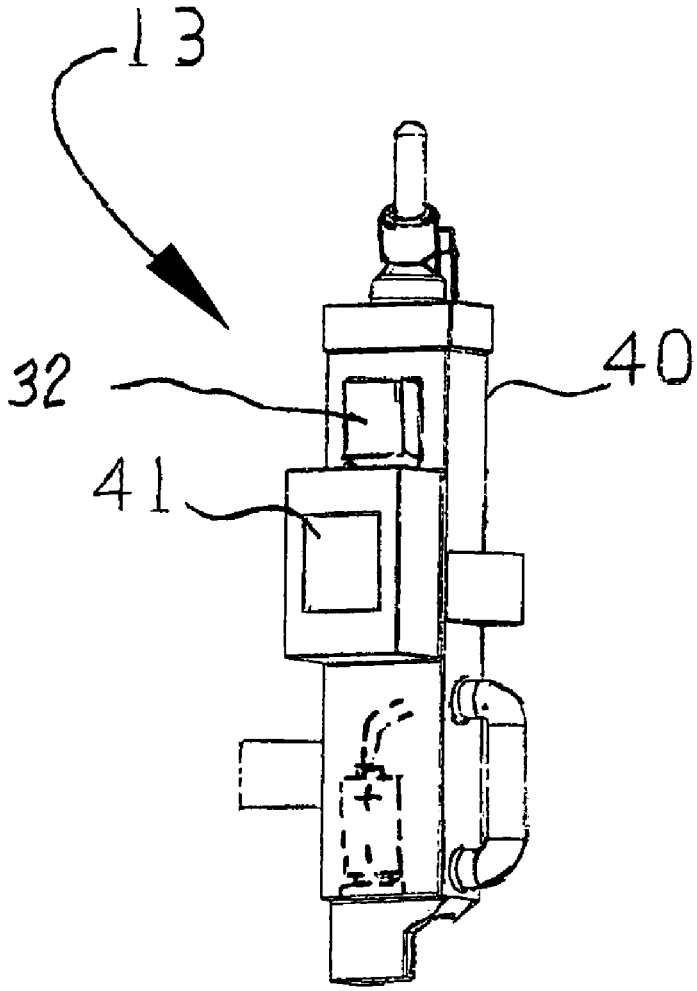
FIG. 7 is an illustration of an EOT device for a model train according to an embodiment of the present invention.
Figure 7A:
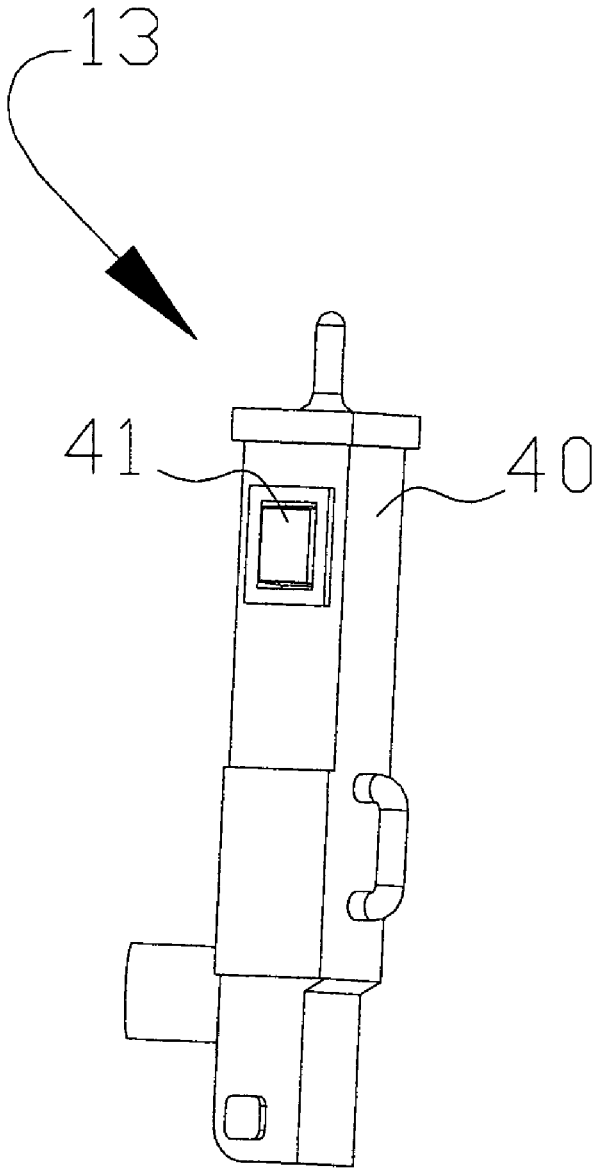
FIG. 7A is an illustration that shows a different design of the EOT device.

As seen in FIG. 3, circuit board assembly, generally designated 11, includes board 32 having an aperture 34 and circuits 33 disposed thereon. Contacts 33 are disposed on board 32 and are engageable with the axle assembly 14. As seen in FIG. 3A, bushings 36 can be used to replace contacts 31.

Since the presently preferred invention contains a programmable microcontroller on the electronic board 11 and there are modern digital control systems that provide digital control signals for various types of devices, those signals can be received by the microcontroller to control the functions of the EOT device, such as enabling and disabling the flashing of the EOT device's light.

Figure 1B:
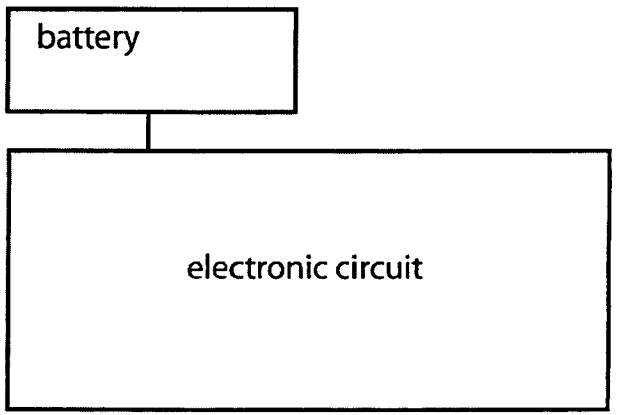
FIG. 1B is a schematic block diagram of the electrical circuit and an on-board battery.
Figure 1A:
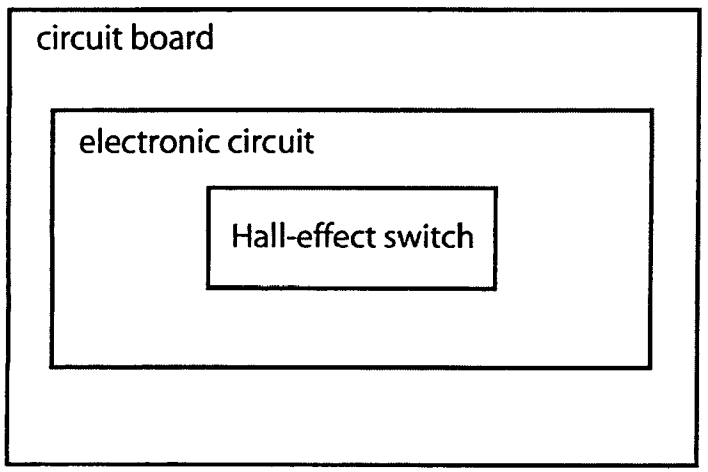
FIG. 1A is a schematic block diagram of the circuit board assembly.
Figure 2:
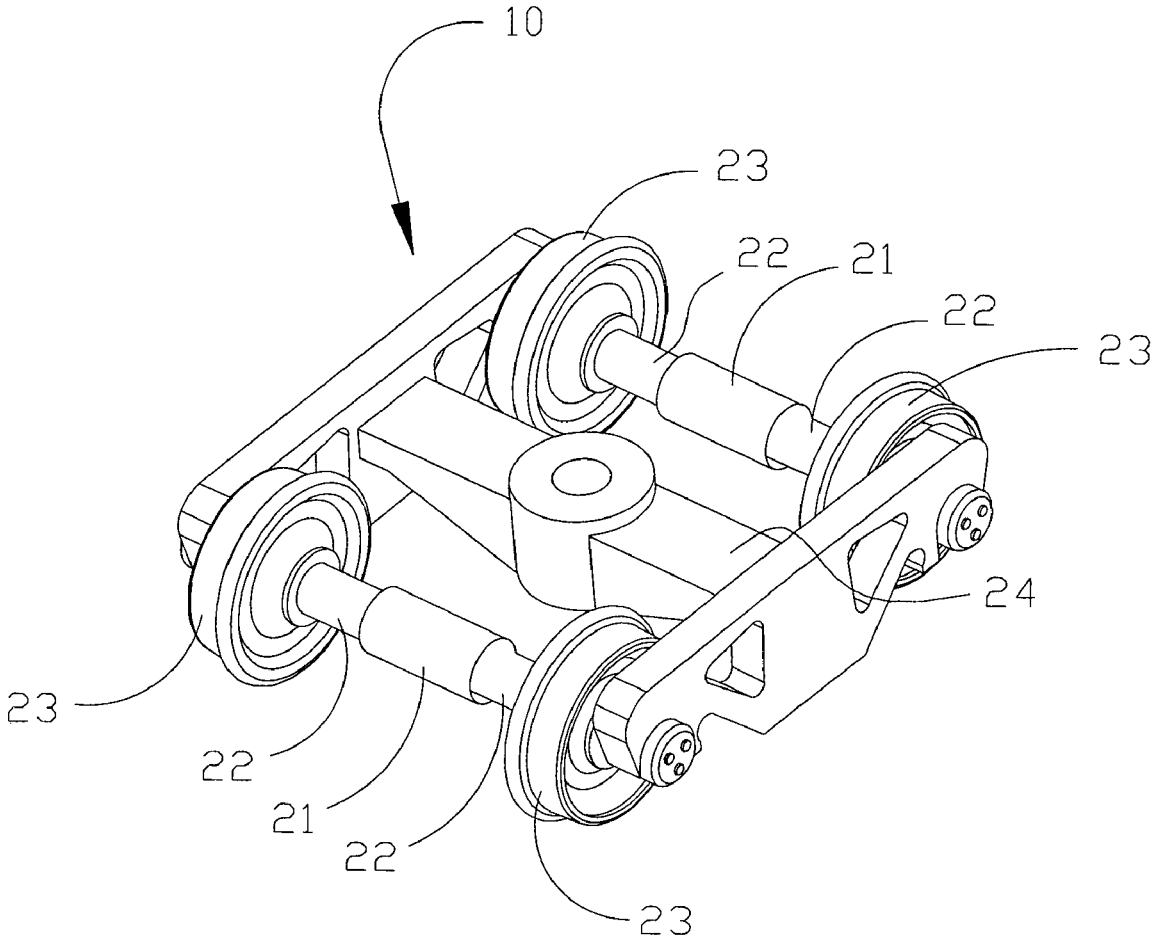
FIG. 2 is an illustration of a truck assembly used on a model train railway vehicle constructed according to one presently preferred embodiment of the invention.

A magnetic device, such as a Hall-effect switch, could also be incorporated into the electrical circuit design, as shown in FIG. 1A, for controlling the EOT device's functions.

Furthermore, because of the low power requirements of modern microcontrollers and LED's, an energy storage device, such as a battery, could be mounted on the truck providing the same ease of installation and moving between model rail cars as desired.

It can be seen from the above description that the present invention provides an apparatus for converting electrical energy into a usable signal for the flashing of an EOT device's light for prototypically accurate model train layouts. The apparatus is relatively easy to install and relocate from one model train car to another. This apparatus includes at least one electrical circuit. The preferred electrical circuit must have at least one pair of electrically conductive track contacts disposed thereon.

Another option, as shown in FIG. 1B, although not presently preferred, for the electrical circuit power could be an on-board power source, such as a battery or other potential source of electrical energy. The preferred circuit has the capability of adjusting the flash rate of the EOT device's light through a software program. A light element such as a light emitting diode to receive the converted signal is also attached to the electrical circuit.

While a presently preferred embodiment as well as a number of alternative embodiments of the instant invention have been described in detail above, it should be recognized by those persons skilled in the art that various other modifications and adaptations can be made without departing from either the spirit of the invention or the scope of the appended claims.

I claim:

1. An apparatus for use in converting electrical energy to a signal which is suitable for driving a light element in a model train End of Train (EOT) device, said apparatus comprising:

(a) an EOT device engageable with a model railway vehicle having at least one truck assembly equipped with a circuit board assembly connected by wires that can be easily installed and removed for relocation between model railway vehicles;

(b) electronic circuit on said circuit board assembly for operating said EOT device, and for power conversion and light signal timing;

(c) at least two electrically conductive wheels disposed upon said truck assembly to provide power to said electronic circuits; and (d) at least one light element disposed in and on said EOT device and connected by said wires to receive a signal from said electronic circuit.

2. An apparatus, according to claim 1, wherein said electronic circuit includes a microcontroller for accurate timing of said light element.

3. An apparatus, according to claim 1, wherein said circuit board assembly is reduced to a size to fit beneath an HO (1/87th) scale truck assembly.

4. An apparatus, according to claim 1, wherein said electronic circuit is designed for installation on most model trains.

5. An apparatus, according to claim 1, wherein said electronic circuit includes a power conditioning circuit having full wave rectification.

6. An apparatus, according to claim 5, wherein said electronic circuit includes electrical filters.

7. An apparatus, according to claim 5, wherein said electronic circuit includes voltage regulation.

8. An apparatus, according to claim 1, wherein said electronic circuit receives control signals from said electrically conductive wheels to control said EOT device's light element.

9. An apparatus, according to claim 1, wherein said apparatus further includes a hall effect switch that senses magnetic fields and is used to control said light element.

10. An apparatus, according to claim 1, wherein said EOT light element is a light emitting diode for reducing power consumption and for providing high luminance output.

11. An apparatus, according to claim 1, wherein said electronic circuit is powered by analog power picked up from said electrically conductive wheels.

12. An apparatus, according to claim 8, power picked up from said electrically conductive wheels alternates in polarity and contains digitally encoded information to control said light element.

13. An apparatus for use in converting electrical energy to a signal suitable for driving a light element in a model train End of Train (EOT) device, said apparatus comprising:

(a) an EOT device and at least one truck having a circuit board assembly connected by wires, said EOT device engageable with a model railway car body that can be easily installed and removed for relocation between model railway car bodies;

(b) an electronic circuit on said circuit board assembly for operating said EOT device, and for power conversion and light signal timing;

(c) at least one on-board battery to provide power to said electronic circuit; and (d) at least one light element disposed in and on said EOT device and connected by said wires to receive a signal from said electronic circuit.

* * * * *